US005154818A

United States Patent [19]

Harandi et al.

[11] Patent Number: 5,154,818

[45] Date of Patent: Oct. 13, 1992

[54] MULTIPLE ZONE CATALYTIC CRACKING OF HYDROCARBONS

[75] Inventors: Mohsen N. Harandi, Lawrenceville; Hartley Owen, Belle Mead, both of N.J.

[73] Assignee: Mobil Oil Corporation, Fairfax, Va.

[21] Appl. No.: 749,483

[22] Filed: Aug. 15, 1991

Related U.S. Application Data

[63] Continuation of Ser. No. 527,985, May 24, 1990, abandoned.

[51] Int. Cl.[5] ..... C10G 51/02; C10G 51/04; C10G 11/02

[52] U.S. Cl. ..... 208/74; 208/75; 208/72; 208/73; 208/77; 208/67; 208/49; 208/113; 208/120

[58] Field of Search ..... 208/74, 75, 72, 73, 208/77, 67, 49, 113, 120

[56] References Cited

U.S. PATENT DOCUMENTS

| | | | |
|---|---|---|---|
| 2,852,441 | 9/1958 | Martin et al. . | |
| 2,908,630 | 10/1959 | Friedman . | |
| 3,784,463 | 1/1974 | Reynolds et al. | 208/74 |
| 3,821,103 | 6/1974 | Owen et al. | 208/72 |
| 3,849,291 | 11/1974 | Owen | 208/78 |
| 3,886,060 | 5/1975 | Owen | 208/120 |
| 3,894,935 | 7/1975 | Owen | 208/78 |
| 4,090,948 | 5/1978 | Schwarzenbek | 208/74 |
| 4,116,814 | 9/1978 | Zahner | 208/78 |
| 4,218,306 | 8/1980 | Gross et al. | 208/120 |
| 4,436,613 | 3/1984 | Sayles et al. | 208/74 |
| 4,624,771 | 11/1986 | Lane et al. | 208/74 |
| 4,752,375 | 6/1988 | Herbst et al. | 208/74 |

*Primary Examiner*—Asok Pal
*Assistant Examiner*—Nhat Phan
*Attorney, Agent, or Firm*—Alexander J. McKillop; Charles J. Speciale; Malcolm D. Keen

[57] ABSTRACT

Methods for the fluidized catalytic cracking of plural hydrocarbon feedstocks in a riser reactor are disclosed. The processes generally comprises contacting a relatively light hydrocarbon feedstock in a first reaction zone with a first catalyst stream comprising spent catalyst, contacting a relatively heavy hydrocarbon feedstock in a second reaction zone with a second catalyst stream comprising freshly regenerated catalyst, and introducing at least a portion of the effluent from the first reaction zone into the second reaction zone. The first reaction zone and the second reaction zone preferably comprise first and second riser reaction zones, respectively.

19 Claims, 2 Drawing Sheets

MULTIPLE ZONE CATALYTIC CRACKING OF HYDROCARBONS

This is a continuation of copending application Ser. No. 07/527,985 filed on May 24, 1990, now abandoned.

This invention relates to methods and apparatus for cracking hydrocarbon feedstocks in the presence of a cracking catalyst. More particularly, the present invention relates to the fluid catalytic cracking of plural hydrocarbon feedstocks.

Several processes for the cracking of hydrocarbon feedstocks by contact at appropriate temperatures and pressures with fluidized catalytic particles are known in the art. These processes are generally referred to as "fluid catalytic cracking" (FCC) operations. In FCC operations hydrocarbon feedstocks are contacted with hot, finely divided catalytic particles. In many of the earlier FCC designs, such contact took place in a dense fluidized bed reactor. More recent FCC designs utilize an elongated transfer line reactor having a relatively dilute phase fluidized system. Reactors of this general design are usually known as "riser reactors". In either design, the hydrocarbon feedstock is maintained at a relatively elevated temperature in a fluidized or dispersed state for a time sufficient to affect the cracking of the feedstock to lower molecular weight hydrocarbons. In many FCC processes, the preferred products of the reaction process are high octane liquid fuels, such as gasoline.

In typical FCC cracking processes, liquid or partially vaporized hydrocarbon feedstock is contacted with hot, freshly regenerated catalyst in the lower section of the riser reaction zone. As the hydrocarbon and catalyst flow as a suspension through the riser, the hydrocarbon feedstock is cracked to produce low molecular weight hydrocarbons, gaseous by-products and carbonaceous material known as catalytic coke. The catalytic coke, along with other sources of coke, such as high asphaltic type compounds contained in the hydrocarbon feed stock, are deposited on the surface of the catalyst particles as the suspension moves through the riser. These coke deposits are catalyst poisons and cause a partial reduction in the effective cracking activity of the catalyst. This partially deactivated catalyst is commonly referred to as "spent" catalyst. The reaction products and spent catalyst are discharged from the outlet of the riser into a separator, such as a cyclone unit. The reaction products entering the separator, which is typically located within the upper section of an enclosed stripping vessel, are conveyed to a product recovery zone for further processing and separation. The spent catalyst is transferred to a dense catalyst bed within the lower section of the stripper. An inert stripping gas, such as steam, passes over the catalyst in the lower section of the stripping vessel in order to remove entrained hydrocarbon product from the spent catalyst.

In order to reactivate the spent catalyst, the spent catalyst is transferred from the stripping section to a catalyst regenerating unit where the coke deposits contained on the catalyst particles are combusted by an oxygen containing gas, usually air. The regenerated catalyst, which has gained heat due to the regeneration process, is recycled to the riser where it contacts additional hydrocarbon feedstocks.

The quality and quantity of the hydrocarbon reaction products produced in FCC operations is dependent upon a relatively large number of processing parameters. For example, the temperature in the riser reactor is known to have a significant impact upon the overall rates of reaction that occur during the cracking operation. Moreover, the time that the reactants spend in contact with the hot catalyst is also known to have a significant effect upon the reaction products produced. Other important process variables include the catalyst to feedstock ratio, catalyst type, and the number and diversity of feedstocks being cracked.

With respect to catalyst type, the present trend in FCC operations is to employ more active and selective cracking catalysts, such as those comprising crystalline zeolites, for performing the conversion of one or more hydrocarbon feedstocks to gasoline boiling range products. The recent development of new synthetic zeolite catalysts, together with the discovery that these catalysts can be transformed into stable and more gasoline selective catalysts than conventional amorphous silica alumina, has lead to a large number of catalysts which are particularly advantageous in certain cracking operations. The major conventional cracking catalysts presently in use generally comprise large pore crystalline silica zeolite, generally in a suitable matrix component which may or may not itself possess catalytic activity. Many prior art systems adapted for use with high activity crystalline zeolite cracking catalysts result in less than maximum utilization of catalyst capabilities and undue catalyst regeneration. See U.S. Pat. No. 3,849,291—Owen, col. 1, lines 29–34. Thus, there has been a long-felt need in the art for FCC processes which are capable of exploiting the potential advantages possessed by the various catalysts available.

A large number of hydrocarbon feedstocks are typically subject to catalytic cracking operations of the type described above in petroleum refining operations. For example, hydrocarbon feedstocks as light as liquid petroleum gas (LPG) and as heavy as vacuum gas oil (VGO) are cracked in FCC operations. Frequently, these plural feedstocks have different cracking characteristics and coke producing tendencies. In many instances, therefore, the process variables that are preferred for one feedstock are frequently far from preferred for a second feedstock. Nevertheless, such diverse materials are frequently the subject of fluid catalytic cracking in petroleum refinery operations. Typical prior art FCC processes have suffered from the inability to produce the most favorable set of reaction products from the variety of feedstocks available for cracking.

One process for the simultaneous cracking of both light and heavy hydrocarbon feedstocks is disclosed in U.S. Pat. No. 3, 894,935—Owen. This patent discloses the fluid catalytic cracking of a gas oil and a $C_3$–$C_4$ rich fraction in separate conversion zones in the presence of a faujasite conversion catalyst. According to the process disclosed in this patent, freshly regenerated conversion catalyst may be used in each separate conversion zone or spent catalyst may be directed, after stripping, to the conversion zone for the $C_3$–$C_4$ rich hydrocarbon feed. While the processes disclosed in U.S. Pat. No. 3,894,935—Owen permits multiple feedstock catalytic cracking operations, it is generally subject to certain disadvantages. For example, processes of the types disclosed in FIGS. 1 and 2 require the provision of a separate riser for each feedstock being cracked. Such an arrangement will generally tend to increase the cost of the operating equipment associated with such processes. U.S. Pat. No. 3,849,291—Owen also discloses fluid catalytic cracking operations utilizing multiple risers and the introduction of spent catalyst into one of said risers.

Certain prior art processes have attempted to take advantage of the availability of catalysts having distinct properties to maximize yield slate from catalytic cracking operations. For example, U.S. Pat. No. 4,116,814—Zahner is directed to methods and systems for cracking hydrocarbons with distinct fluid catalyst particles differing in activity, selectivity and physical characteristics. Although the process scheme disclosed by Zahner requires only a single shared regeneration vessel, a complete separate riser reactor system is required for each type of catalyst being used. Thus, the benefits of the Zahner process apparently come only at the expense of relatively high equipment costs.

Several other known processes employ a mixture of catalysts having different catalytic properties. For example, the process disclosed in U.S. Pat. No. 3,894,934 utilizes a mixture of a large pore crystalline silica zeolite cracking catalyst, such as zeolite Y, in conjunction with a shape selective or medium pore silica zeolite such as ZSM-5. In the type of process disclosed in U.S. Pat. No. 3,894,934 the catalyst is separated from the product effluent and conveyed to a stripper and from there to a catalyst regeneration zone. In such operations, however, the different catalyst types will generally become fairly uniformly mixed and will eventually circulate throughout the system at about the same rate. This arrangement is subject to significant disadvantages. For example, coke is deposited on a large pore zeolite cracking catalyst relatively more quickly than the medium pore zeolite catalyst, and thus the former requires more frequent regeneration than the latter. In typical prior processes, however, this significant advantage of the medium pore zeolite catalysts was not utilized and both catalysts were regenerated at the same rate. Thus, a principle disadvantage of prior mixed catalyst systems is that the medium pore zeolite catalyst is subject to the harsh hydrothermal conditions of the catalyst regeneration unit at the rate required by the large pore crystalline zeolite catalyst. The medium pore zeolite is therefore needlessly subjected to regeneration at a much greater rate than is necessary.

SUMMARY OF THE INVENTION

In view of the disadvantages and long-felt needs of the prior art, it is an object of the present invention to provide apparatus and methods for catalytically cracking diverse hydrocarbon materials to yield a relatively large quantity of desirable products, such as high octane gasoline and distillate, in a relatively simple and cost effective processing system. These and other objects of the present invention are satisfied by a process for the fluid catalytic cracking of at least two hydrocarbon feedstocks in the presence of finely divided solid catalytic cracking catalyst. The processes generally comprise contacting a relatively light hydrocarbon feedstock in a first reaction zone with a first catalyst stream comprising spent catalyst, contacting a relatively heavy hydrocarbon feedstock in a second reaction zone with a second catalyst stream comprising freshly regenerated catalyst, and introducing at least a portion of the effluent from the first reaction zone into the second reaction zone. The first reaction zone and the second reaction zone preferably comprise first and second riser reaction zones, respectively.

Applicants have surprisingly found that spent catalyst particles generally have properties that are particularly advantageous for the catalytic cracking of relatively light hydrocarbon feedstocks. For example, spent catalyst particles have been found to promote selective aromatization and oligomerization of the relatively light hydrocarbon feedstocks, thus improving both gasoline yield and octane. The selectivity of the reactions which occur with spent catalyst is due, in part, to the relatively low temperature of the spent catalyst stream.

According to one particular aspect of the present invention, light hydrocarbon cracking selectivity is even further enhanced by including medium pore zeolite catalyst in the spent catalyst stream. This aspect of the present invention is particularly beneficial since such medium pore zeolites generally require less frequent regeneration than many other catalyst components. Certain preferred embodiments of the present invention therefore provide an FCC process having a mixed catalyst system comprising an amorphous and/or large pore crystalline cracking catalyst component and a shape selective or medium pore zeolite catalyst component. The properties of the catalyst particles, such as density, size and/or shape, are preferably selected such that the different catalyst types are readily separable.

It has also been discovered that the catalytic cracking of relatively heavy hydrocarbon feedstocks is enhanced when relatively light hydrocarbon feedstocks are cracked in a first riser reaction zone and the effluent from the first reactor is introduced into a second reaction zone used for catalytically cracking the heavy hydrocarbon in the presence of freshly regenerated catalyst. Applicant has found that such an arrangement minimizes undesirable thermal cracking of the light and heavy feedstocks. This reduction in thermal cracking minimizes production of undesirable diolefins and results in increased gasoline octane.

DETAILED DESCRIPTION OF PREFERRED EMBODIMENTS

Figure 1:
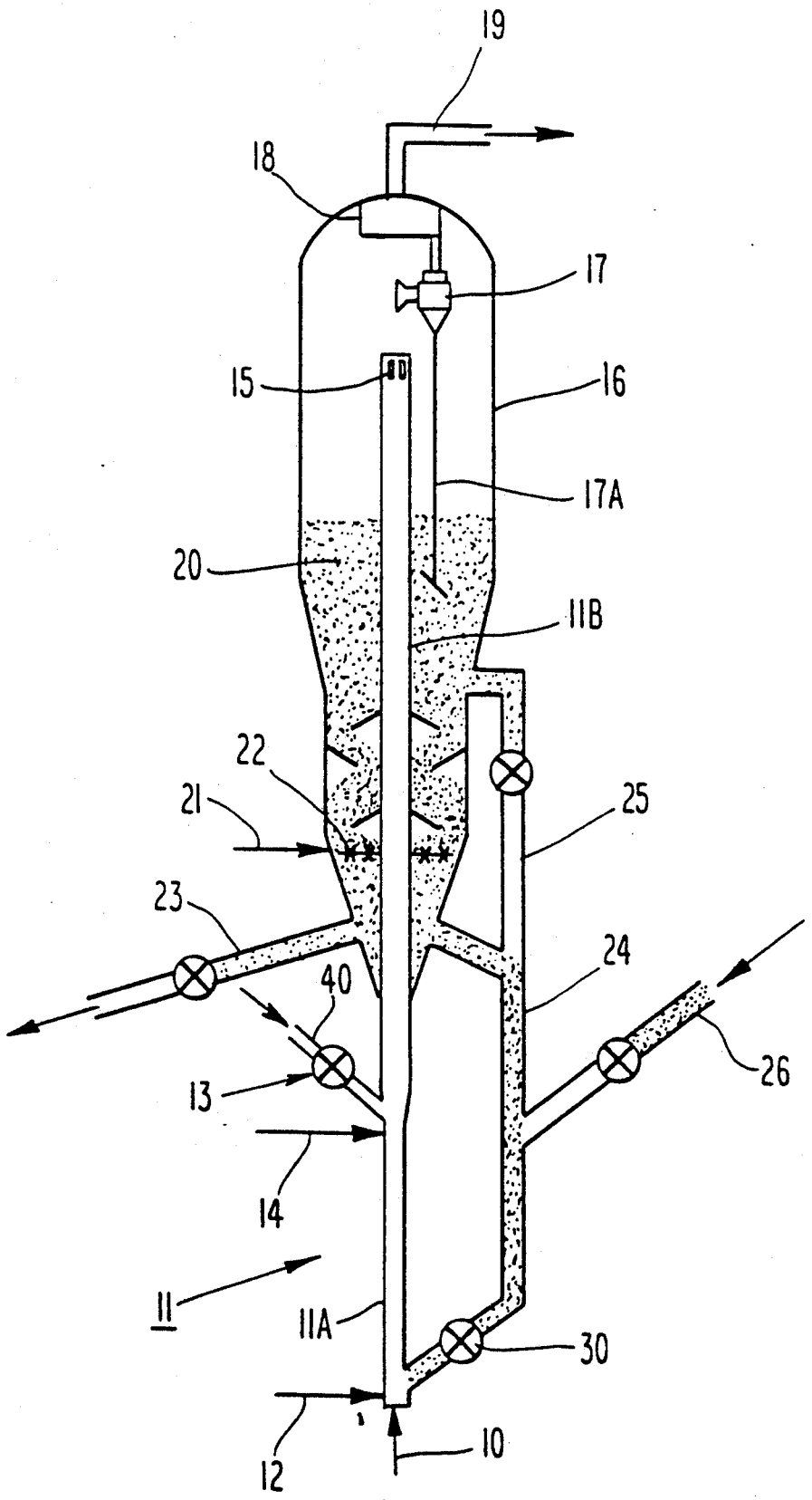
FIGS. 1 and 2 of the drawings show in simplified form two catalytic cracking units for operating the present process.

The methods of the present invention comprise the step of contacting a relatively light hydrocarbon feedstock with a first stream or collection of catalyst particles comprising spent catalyst to convert at least a portion of the hydrocarbon feedstock to reaction products. According to certain preferred embodiments of the present invention, the first catalyst stream consists essentially of spent catalyst. As the term is used herein, spent catalyst refers to catalyst that is at least partially deactivated due to the presence of coke on at least a portion the catalyst surface. The term is used in its relative sense to distinguish from "regenerated" catalyst particles of the present invention, that is, those particles which have undergone a greater degree of regeneration than the spent catalyst. Thus, the methods of the present invention contemplate the use as spent catalyst of not only those catalyst particles which have undergone no regeneration but also of those particles that have been partially regenerated or regenerated to a lesser extent than the freshly regenerated catalyst.

As the term is used herein, light hydrocarbon feedstock refers to relatively low boiling, low molecular weight hydrocarbon materials used as feedstocks in FCC operations. Thus, the term light hydrocarbon feedstock is also used in its relative sense to distinguish from heavy hydrocarbon feedstocks, that is, those hydrocarbon materials having boiling ranges and/or molecular weights that are high relative to the light hydrocarbon feedstock. Thus, while it is preferred that the light hydrocarbon feed be selected from the group consisting of lift fuel gas, LPG, medium cut naphtha, heavy cut naphtha, distillate and mixtures thereof, other hydrocarbon feedstocks, such as gas oils, may also be used.

The light hydrocarbon feedstock is preferably contacted with spent catalyst in a first dilute phase riser reaction zone. According to techniques well known and understood in the art, the step of contacting the light hydrocarbon feedstock with spent catalyst in a riser reaction zone preferably comprises introducing the light hydrocarbon feedstock and the catalyst into a tubular reactor where the spent catalyst particles and hydrocarbon material are intimately mixed as they are carried as a suspension through the riser. As the term is used herein, a riser reaction zone refers to a length of the reactor wherein catalyst particles and hydrocarbon are in intimate contact under conditions sufficient to achieve conversion of at least a portion of the hydrocarbon to reaction products.

The spent catalyst/light hydrocarbon suspension may be formed with or without the aid of a fluid which acts as a lift gas and/or diluent. For the purposes of convenience, such fluids are referred to herein as motive fluids. Such fluids, such as wet or dry recycled gas or steam, may be used to reduce hydrocarbon partial pressure and/or control contact time in the first riser reaction zone by increasing total velocity of the suspension in the reactor. According to certain aspects of the present invention, the use of motive fluid is preferred since it assists in breaking up the light hydrocarbon feed into relatively fine droplets which more uniformly distribute themselves in intimate contact with the spent catalyst particles. Motive fluids which may be of use include gaseous materials such as steam, light gaseous hydrocarbons known as dry gas ($C_3$ or lighter hydrocarbon) and wet gaseous hydrocarbon streams such as those comprising $C_4$ and $C_5$ hydrocarbons. In certain embodiments, the motive fluid is first combined with spent, relatively low temperature catalyst to form a suitable suspension. The relatively light hydrocarbon feed is introduced into the flowing suspension and converted to desired products during transverse of the first riser reaction zone. According to other embodiments, the light hydrocarbon feedstock and the spent catalyst are introduced together with any motive fluid at the entrance of the first riser reaction zone. The hydrocarbon residence time in the first reaction zone is preferably from about 0.5 to about 10 seconds, and more preferably from about 0.5 to about 3 seconds.

The temperature of the catalyst stream entering the riser in the first riser reaction zone is preferably no greater than about 1100° F., and even more preferably about 1000° F. The temperature of the light hydrocarbon feedstock may vary widely but is preferably between about 300° and 800° F. As will be appreciated by those skilled in the art, the spent catalyst temperature is generally less than the temperature of freshly regenerated catalyst. Applicant has found that the use of such relatively low-temperature, spent catalyst for cracking of light hydrocarbon feedstock has several beneficial results according to the practice of the present invention. For example, the use of spent catalyst generally results in a relatively low first reaction zone temperature, thus minimizing the occurrence of hot spots in the first reaction zone and largely avoiding deleterious thermal cracking of the light hydrocarbon feedstock. The first reaction zone temperature is therefore preferably from about 700° to about 1000° F., and even more preferably 650° to about 900° F. As the term is used herein, first reaction zone temperature refers to the temperature of the suspension at the point of initial contact between the spent catalyst and light hydrocarbon feedstock. This temperature is readily calculated by performing an enthalpy balance around the initial mix point and by assuming no heat of reaction at the initial mix point.

In alternate embodiments of the present invention, the step of contacting light hydrocarbon feedstock with spent catalyst comprises passing the light hydrocarbon feedstock through a first riser reaction zone in the presence of a mixed catalyst system comprising first and second catalyst particles, wherein the first catalyst particles tend on the average to remain in the first reaction zone longer than the second catalyst particles. Ordinarily, in a mixed catalyst system, both catalyst components will move through the riser at about the same rate. In accordance with one embodiment of the present invention, however, it is preferred to retain a first catalyst particle within the first riser reaction zone for a extended period of time relative to the second catalyst particle. In fact, the first catalyst particle can be configured so as to remain more or less stationary, or suspended, at any desired level within the first riser reaction zone. In this way, the second catalyst particle is more frequently regenerated than the first catalyst particle, and the first catalyst particle is therefore spent catalyst within the meaning of the present invention.

Applicant has found that by appropriate selection of one or more physical properties of the catalyst particle, such as average particle size, density and/or geometry, it is possible to provide a first catalyst particle which possesses a settling rate which is less than the settling rate of the second catalyst component. For example, the residence time of catalyst particles in a vertically arranged riser reaction zone is primarily dependent on two factors: the linear velocity of the suspension in the riser reaction zone, which tends to carry the contents of the reaction zone up and out of the reaction zone; and the opposing force of gravity, which tends to keep the catalyst particles in the riser. To bring about the necessary balance of catalyst physical properties, or to otherwise prolong the residency time of the first catalyst particle within the riser, the average density, particle size and/or shape of the catalyst particles is adjusted so as to provide the desired settling characteristics. As a general guide, as the average particle size of the catalyst increases and/or its average particle density increases, the residence time of the catalyst will increase. This particular aspect of the present invention is more particularly disclosed in U.S Pat. No. 4,871,446 Herbst, et al., which is incorporated herein by reference.

The methods of the present invention also generally comprise the step of contacting a relatively heavy hydrocarbon feedstock and/or the reaction products thereof with a second catalyst stream comprising freshly regenerated catalyst. According to certain preferred embodiments, the second catalyst stream consists essentially of regenerated catalyst. As the term is used herein, regenerated catalyst refers to catalyst particles that have had their activity restored, generally via combustion of coke deposits on the catalyst. As described above, the term regenerated catalyst is used in its relative sense to distinguish from "spent catalyst" particles of the present invention. As the term is used herein, heavy hydrocarbon feedstock refers to those relatively high boiling, high molecular weight hydrocarbon materials used as feedstocks in FCC operations. Thus, the term heavy hydrocarbon feedstock is also used in its relative sense to distinguish from light hydrocarbon feedstocks as described above. Although the use of a wide variety of hydrocarbons is contemplated for use as the heavy hydrocarbon feedstock, the use of liquid hydrocarbon feeds is generally preferred. As used herein, the term liquid hydrocarbon refers to those hydrocarbons which are liquid at standard conditions. Accordingly, the heavy hydrocarbons of the present invention are preferably selected from the group consisting of residual oils, atmospheric gas oils, vacuum gas oils, coker gas oils, catalytic gas oils, hydrotreated gas oils, naphthas, catalytic naphthas, topped crudes, deasphalted oils, hydrotreated resids (HDT resids), hydrocracked resids, shale oil and mixtures of these.

The heavy hydrocarbon feedstock and/or the reaction product thereof is preferably contacted with regenerated catalyst in a second dilute phase riser reaction zone. As explained more fully herein after, the present methods also generally comprise introducing at least a portion of the effluent from the first riser reaction zone into the second riser reaction zone. It is thus contemplated that according to certain embodiments of the present invention the heavy hydrocarbon feedstock may be contacted with spent catalyst from the first riser reaction zone prior to being contacted by regenerated catalyst. It will be appreciated by those skilled in the art that some reaction products will be formed almost instantaneously upon such contact. For the purposes of convenience, therefore, reference herein to contact between regenerated catalyst and heavy hydrocarbon feedstock is intended to include contact with reaction products of the hydrocarbon feedstocks.

The regenerated catalyst particles and the heavy hydrocarbon feedstock are preferably intimately mixed in the second riser reaction zone to form a suspension comprising freshly regenerated catalyst and heavy hydrocarbon feedstock. It will be appreciated that reaction products are formed almost instantaneously upon contact of the regenerated catalyst and heavy hydrocarbon feedstock. Moreover, the freshly regenerated catalyst particles are also almost instantaneously partially deactivite due to the presence of residual coke in the feed. The suspension may be formed with or without the aid of a motive fluid, as discussed above. Thus, it is within the scope of the present invention to first form a suspension of freshly regenerated catalyst, using, for example, motive fluid, and then to introduce the heavy hydrocarbon into the suspension thus formed. It is generally preferred, however, to introduce the freshly regenerated catalyst and heavy hydrocarbon feedstock together at about the entrance to the second reaction zone. The temperature of the regenerated catalyst stream entering the second riser reaction zone is preferably at least about 1100° F., and even more preferably between about 1200° and 1400° F. The temperature of the heavy hydrocarbon feedstock may vary widely but is preferably between about 500° and 800° F. The second reaction zone temperature is preferably from about 950° to about 1200° F., and even more preferably from about 1000° to about 1100° F. As the term is used herein, second reaction zone temperature refers to the temperature of the suspension at the point of initial contact between the regenerated catalyst and the heavy hydrocarbon feedstock. This temperature is readily calculated by performing an enthalpy balance around the initial mix point and by assuming no heat of reaction at the initial mix point.

According to one important aspect of the present invention, at least a portion of the effluent from the first reaction zone is introduced into the second reaction zone. Depending upon the reaction conditions, the first reaction zone effluent may include unconverted light hydrocarbon feedstock in addition to spent catalyst, reaction products and/or motive fluid. Although it is contemplated that the first reaction zone effluent may be introduced into the second reaction zone at any location therealong, it is preferably introduced into the second reaction zone at about the introduction location of the second catalyst stream. According to one preferred embodiment, at least a portion of the first reaction zone effluent and the heavy hydrocarbon feedstock are first intimately mixed and then introduced together into the second riser reaction zone. This may be achieved, for example, by introducing the heavy hydrocarbon feedstock into a downstream portion of the first riser reaction zone. In this way, the methods of the present invention achieve a gradual and uniform increase in the temperature of the suspension in the second reaction zone. This in turn minimizes hot spots in the second reaction zone and hence thermal cracking of the heavy hydrocarbon feedstock. Moreover, this arrangement helps reduce rapid deactivation of the regenerated catalyst and hence increases the selectivity of the heavy hydrocarbon reaction. In particular, the initial contact between the spent catalyst and the heavy hydrocarbon results in deposition of residual coke on the already spent catalyst. This residual coke would otherwise tend to rapidly deactivate the regenerated catalyst.

For a constant conversion of the heavy hydrocarbon feedstock, the processes of the present invention have even further advantages. At constant conversion, the present processes permit relatively low second reaction zone temperatures, which in turn significantly reduce olefins production and increase gasoline octane.

The methods of the present invention are adaptable for use with all known catalyst types. The major cracking catalyst type most typically used is large pore crystalline silicate zeolite, generally in a suitable matrix component which may or may not itself possess catalytic activity. These zeolites typically possess an average crystallographic pore dimension of at least about 7.0 angstroms for the major pore opening. Representative large pore zeolite cracking catalysts include zeolite X (U.S. Pat. No. 2,882,244, which is incorporated herein by reference), zeolite Y (U.S. Pat. No. 3,130,007, which is incorporated herein by reference), and zeolite US-Y.

While it is contemplated that the same or similar catalyst type be used for both the spent catalyst and the freshly regenerated catalyst of the present invention, applicants have discovered that plural, or dual, catalyst systems may be beneficially used according to the present methods. The present methods thus preferably employ a mixed catalyst system comprising first and second catalyst types. While the separate catalyst types may be combined on a single catalyst particle, it is preferred that each catalyst type be present as separate discrete particles. It is, of course, within the scope of this invention to employ two or more of the foregoing amorphous and/or large pore crystalline cracking catalyst types as the first and second catalyst type. It is preferred, however, that the regenerated catalyst stream of the present invention comprise catalyst particles containing one or more of the amorphous and/or large pore crystalline silicate cracking catalysts while the spent catalyst stream comprise medium pore zeolite, also known as shape selective zeolites.

Preferred large pore crystalline silicate zeolite components comprise any such catalytic cracking component which is active with respect to converting the molecular constituent of the heavy hydrocarbon feedstock to desired components. Generally speaking, the large pore cracking component may be a porous cracking component such as silica/alumina and more particularly a crystalline alumina silicate zeolite cracking component having relatively uniform pore dimensions and a pore size selected from within the range from about 6 to about 15 angstrom units. These relatively large pore zeolite components will admit both normal and isoaliphatics. Particularly desirable large pore zeolites include the synthetic faujasites known as zeolite Y and zeolite X, with particular preference being accorded zeolite Y, REY, USY, and RE-USY.

Preferred medium pore catalyst components are ZSM-5 type catalysts, which generally allow entry into their internal pore structure of normal aliphatic compounds and slightly branched aliphatic compounds, particularly monomethyl substituted compounds, yet substantially exclude all compounds containing at least a quaternary carbon atom or having a molecular dimension equal to or substantially greater than a quaternary carbon atom. Thus, the shape selective, medium pore crystalline silicate zeolite catalyst is exemplified by ZSM-5, ZSM-11, ZSM-12, ZSM-23, ZSM-35, ZSM-38, ZSM-48 and other similar materials. U.S. Pat. Nos. 3,702,886 and 3,849,291 describing ZSM-5 is incorporated herein by reference. ZSM-11 is more particularly described in U.S. Pat. No. 3,709,979, which is incorporated herein by reference. ZSM-12 is more particularly described in U.S. Pat. No. 3,832,449, which is also incorporated herein by reference. ZSM-23 is more particularly described in U.S. Pat. No. 4,076,842, which is incorporated herein by reference. ZSM-35 is more particularly described in U.S. Pat. No. 4,016,245, which is incorporated herein by reference. ZSM-38 is more particularly described in U.S. Pat. No. 4,046,859, which is incorporated herein by reference. ZSM-48 is more particularly described in U.S. Pat. No. 4,375,573, which is incorporated herein by reference.

In general, the alumina silicate zeolites are effectively employed herein. However, zeolites in which some other framework element is present in partial or total substitution of alumina can be advantageous. Illustrative of elements which can be so substituted are boron, gallium, titanium and other trivalent metal heavier than aluminum. Specific example of such catalysts include ZSM-5 and zeolite Beta containing boron, gallium and/or titanium. In lieu of or in addition to, being incorporated into the zeolite framework these and other catalytically active elements can also be deposited upon the zeolite by any suitable procedure.

By appropriate selection of one or more characterizing physical properties, for example, average particle size, density and/or geometry, it is possible to segregate, or separate, catalyst particles comprising a first catalyst component from catalyst particles comprising a second catalyst component in the reaction zone, the stripping zone or both zones. Thus, it is possible to selectively recycle a stream of spent catalyst particles comprising the first catalyst component directly to the first reaction zone and selectively transfer a stream of spent catalyst particles comprising a second catalyst component to a regeneration zone. Such selective separation can be achieved, for example, by making catalyst particles comprising the first catalyst component less dense than catalyst particles containing the second catalyst component. Among the techniques which can be used for making one catalyst component more dense than the other is compositing each catalyst with a matrix component of substantially different density. Suitable porous matrix components of different density, for example, silica-alumina, silica-magnesia, silica-thoria, etc. can be employed for a wide spectrum of density values from which one may develop a particular catalyst particle density. Another useful technique for adjusting the density of the catalyst component is to composite the first catalyst particle with material which tends to coke up faster than the second component, thereby resulting in an increase in the density of the former. Illustrative of such materials are hydrated alumina which insitu forms a transitional alumina which has high coking rate. This embodiment possesses several additional advantages, especially when the first catalyst component comprises medium pore zeolite and the second catalyst component is large pore zeolite. In the coked up state, the composited medium pore zeolite catalyst is more resistant to attrition which results from collision with other particles in the riser; the individual catalyst particles can sustain more collisions. In addition, the coked up composited medium pore zeolite catalyst particles will tend to accumulate metals present in the feed.

With particular reference now to FIG. 1, certain preferred embodiments of the present methods provide a single riser reactor 11 comprising a first riser reaction zone 11A and a second riser reaction zone 11B. Spent catalyst is contacted with light hydrocarbon feed at an initial contact location in the riser, this initial contact location defining the beginning of riser reaction zone 11A. Heavy hydrocarbon and regenerated catalyst are introduced into the suspension at a location downstream of the initial contact location, thereby defining the beginning of second riser reaction zone 11B. More particularly, a light hydrocarbon feed, such as gaseous hydrocarbons comprising $C_5$ and lighter hydrocarbons, is introduced by conduit 10 to the base of first reaction zone 11A. The flow of spent catalysts through conduit 24 is adjusted by control valve 30 to provide the desired and predetermined catalyst/oil ratio, said catalyst/oil ratio preferably being from about 3 to about 20. A motive fluid, such as steam, may also be introduced into the base of reaction zone 11A by conduit 12. The second riser reaction zone 11B is supplied with a second catalyst stream comprising hot, freshly regenerated catalyst by conduit 40. Heavy hydrocarbon feed material is introduced to the bottom of the second riser reaction zone 11B by conduit 14. In the arrangement of FIG. 1, the suspension from reaction zone 11B is discharged through slotted openings 15 at the riser outlet into an enlarged settling zone of reduced fluid stream velocity, such as stripping vessel 16, wherein separation of the solid catalyst particles from the gaseous material is encouraged by a substantial reduction in the suspension velocity. Hydrocarbon vapors then pass through a separation means, such as cyclone 17, for removal of entrained catalyst particles before the hydrocarbon vapors pass into a plenum chamber 18 for removal from the vessel by conduit 19.

Catalyst particles separated from the hydrocarbon vapors in separator means 17 are transferred by dip leg 17A to a relatively dense fluid bed of catalyst 20 maintained in the lower portion of stripping vessel 16. Catalyst thus separated from the reaction products are stripped with a stripping gas, such as steam, supplied by conduit 21 to an appropriate distributing means 22. In operation, the fluid bed of catalyst 20 moves generally downward and counter-current to the stripping gas, and a first portion of the stripped catalyst is removed from a bottom portion of the stripping zone by conduit 23 for transfer to a catalyst regeneration zone, not shown. The fluid bed of catalyst 20 is preferably at a temperature from about 800° F. to about 1000° F., with the temperature in the upper portions of the bed being generally greater than the temperature in the lower portions. A second stripped catalyst stream is removed from the bottom of stripping vessel 16 by conduit 24 and introduced to the bottom portion of first riser reaction zone 11A. Spent catalyst separated from the riser reactor 11 may also be removed from the dense bed 20 by conduit 25 from a location in the upper portions of the dense bed. Such an arrangement has several advantages. For example, the spent catalyst in the upper portion of the dense bed is subject only to a limited stripping action relative to the catalyst removed from the lower portions of the bed. Thus, spent catalyst of a higher temperature can be recycled to the first riser reaction zone. Moreover, such an arrangement has advantage in dual catalyst systems wherein first catalyst particles are configured to have a lower settling rate than second catalyst particles. In such systems, the upper portions of the dense bed will tend to comprise a relatively high concentration of first catalyst particles, and the first catalyst particles can therefore be preferentially conducted to the first riser reaction zone.

The catalyst containing residual carbonaceous material (coke) is then recycled by conduits 24 and/or 25 back to the inlet of the first riser reaction zone 11A. A suspension of spent catalyst in normally gaseous hydrocarbon and steam is thereby formed. The suspension passes upwardly through the first riser conversion zone 11A under conditions effective to convert at least a portion of the light hydrocarbon to desired reaction products, preferably at a light hydrocarbon reaction zone temperature of from about 800° to about 1000° F. and a hydrocarbon residence time of from about 2 to about 15 seconds.

In the embodiment shown in FIG. 1, the first riser reaction zone preferably terminates at about the entrance to the second riser reaction zone, and substantially all of the first reaction zone effluent discharges directly into the entrance of riser reaction zone 11B. According to the preferred embodiment shown in FIG. 1, therefore, freshly regenerated catalyst, heavy hydrocarbon feed and reactor effluent are introduced into the bottom of riser reaction zone 11B. The suspension then passes upwardly through the second riser reaction zone 11B under conditions effective to convert at least a portion of the heavy hydrocarbon to desired reaction products, preferably at a temperature of from about 1000° to about 1200° F. and a hydrocarbon residence time of from about 2 to about 8 seconds.

It will be appreciated by those skilled in the art that the process illustrated as in FIG. 1 is adaptable to many alterations and variations within the scope of the present invention. For example, it may be desirable to introduce a catalyst stream comprising both spent and regenerated catalyst to riser reaction zone 11A. In such embodiments, conduit 26 may be provided for introducing regenerated catalyst into spent catalyst conduit 24. Alternatively, freshly regenerated catalyst may be separately introduced into riser reaction zone 11A at any point therealong. It will also be appreciated by those skilled in the art that it may be desirable to introduce less than substantially all of the effluent from riser reaction zone 11A into riser reactor 11B. It is also contemplated that at least a portion of the effluent from reaction zone 11A may be introduced into reaction zone 11B at a point downstream of the entrance thereof. These and other variations of the apparatus and methods disclosed in FIG. 1 are possible and within the scope of the present invention.

Figure 2:
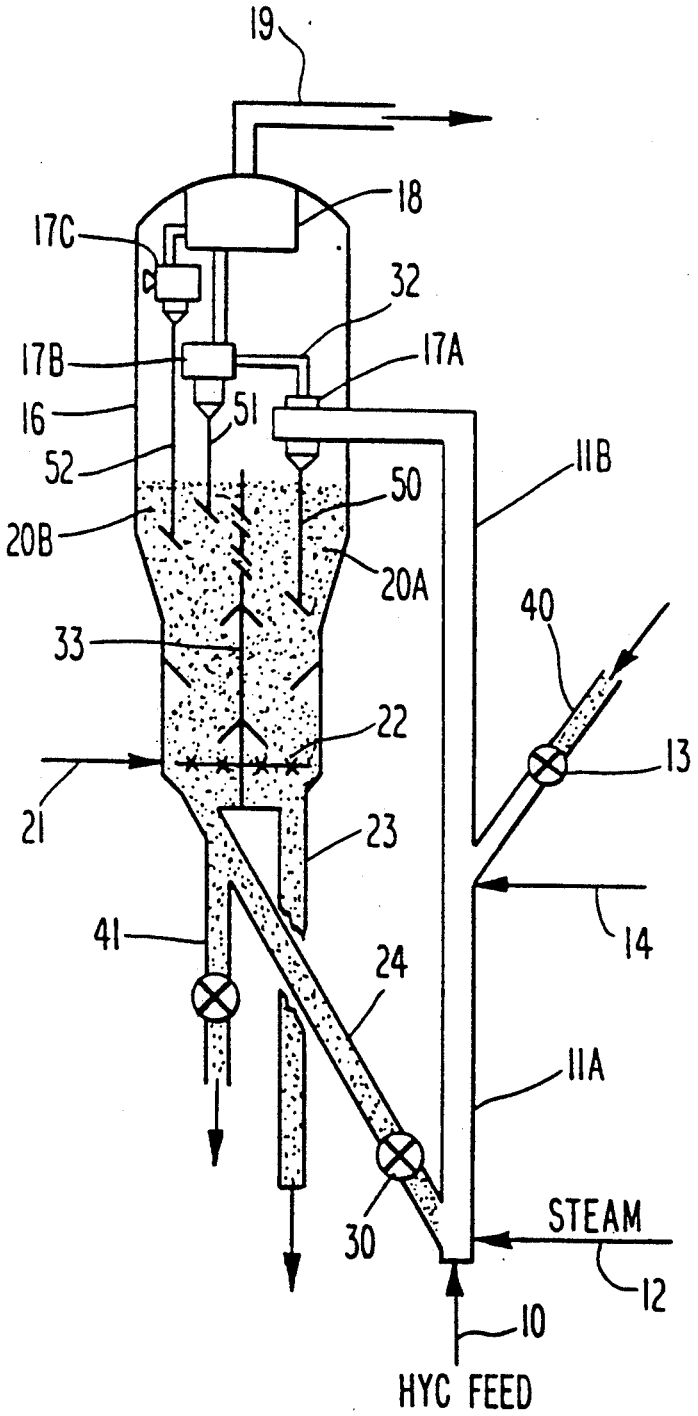

FIG. 2 illustrates an embodiment of the present invention particularly well adapted to catalytic cracking o different hydrocarbon feed materials in the presence of at least two catalytic cracking components. The elements shown in FIG. 2 that are the same or similar to elements shown in FIG. 1 have been designated with the same reference numerals wherever possible. In the arrangement of FIG. 2, a first, relatively light, hydrocarbon feed is introduced by conduit 10 to the base of a first riser reaction zone 11A. Conduit 12 is provided for introducing motive fluid to the base of the riser reaction zone. A catalyst stream comprising spent, medium pore zeolite catalysts is introduced to the base of riser reactor 11A by conduit 24. The flow of catalysts through conduit 24 is adjusted by control valve 30 to provide the desired and predetermined catalyst/oil ratio, said catalyst/oil ratio preferably being from about 3 to about 20. Due to the relatively low temperature of the spent catalyst, the mixture of catalyst, hydrocarbon and steam generally produces a temperature in riser reaction zone 11A of no more than about 1000° F., and preferably between about 850° and about 950° F. The light hydrocarbon feed is at least partially converted in reaction zone 11A to desired reaction products, preferably gasoline boiling products of relatively high octane, as well as higher and lower boiling products.

According to the arrangements of the type shown in FIG. 2, the suspension in reaction zone 11A is introduced to the bottom of reaction zone 11B, along with relatively heavy hydrocarbon feed supplied by conduit 14 and freshly regenerated, large pore zeolite catalysts supplied through catalyst conduit 40. The flow of catalyst through conduit 40 is adjusted by control valve 13 to provide the desired and predetermined catalyst/oil ratio, said catalyst/oil ratio preferably being from about 3 to about 20. The introduction of the hot, freshly regenerated catalyst, coupled with the introduction of the relatively hot effluent from the first riser reaction zone 11A, preferably results in a temperature in the second riser reaction zone 11B of at least about 900° F. and preferably from about 1000° F. to about 1200° F. The temperature selected for accomplishing conversion in the second riser reaction zone 11B will, of course, depend upon the specific product desired from the heavy hydrocarbon feed. The reaction zone at a velocity designed to provide a hydrocarbon residence time of from about 1 to about 12 seconds, and more preferably from about 4 to about 8 seconds.

The suspension formed in reaction zone 11B according to the processing system thus described with respect to FIG. 2 comprises a first collection of catalyst particles containing ZSM-5 type cracking catalyst components and a second collection of catalyst particles containing large pore, crystalline zeolite cracking catalysts. The embodiment of FIG. 2 comprises means for separating the first catalyst particles from the second catalyst particles, means for returning the first catalyst particles to the first reaction zone, and means for transferring the second catalyst particles to a catalyst regeneration zone. More particularly, the suspension from riser 11 is discharged from riser reaction zone 11B into cyclone separator 17A contained in stripping vessel 16. Cyclone separator 17A is adapted to preferentially remove the large pore crystalline zeolite cracking catalyst from the suspension. The separated catalyst is conducted by dip-leg 50 to a first relatively dense bed 20A of fluidized cracking catalyst. The hydrocarbon vapors separated from the suspension in separator 17A, along with the medium pore, ZSM-5 type catalyst particles, are transferred by conduit 32 to a second separator 17B. Separator 17B is adapted to remove the medium pore catalyst particles from the hydrocarbon vapors. These catalyst particles are conducted by dip-leg 51 to a relatively dense fluidized bed of catalyst particles 20B. The hydrocarbon vapors and steam are transmitted to plenum chamber 18 for transfer by conduit 19 to suitable fractionation equipment, not shown.

It will be appreciated by those skilled in the art that the system illustrated in FIG. 2 provides a first dense bed 20B comprising spent, medium pore zeolite catalyst and a second dense bed 20A comprising large pore, zeolite catalyst separated by baffle 33. Dense catalyst beds 20A and 20B move generally downward through the respective stripping sections of vessel 16 in a counter-current fashion to the stripping gas introduced by conduit 21 and distribution means 22. A stripped catalyst stream comprising spent, medium pore zeolite catalyst is transferred by conduit 24 and control valve 30 to the bottom of riser reaction zone 11A. Of course, spent catalyst may also be removed from an upper portion of the dense bed as shown in connection with FIG. 1 and described above. Stripped catalyst is removed from the bottom of dense bed 20A by conduit 23 and conveyed to a regeneration zone, not shown. Stripped products and stripping gas separated from the upper surface of beds 20A and 20B pass through cyclonic separating means 17C. Gaseous material comprising stripping ga separated from entrained catalyst fines pass from separator 17C to plenum chamber 18. Separated catalyst fines are passed by dip leg 52 to bed 20B.

According to a preferred embodiment of the present invention, baffle 33 in stripping vessel 16 is formed with a plurality of passageways or catalyst flow slots 40 and 41. By adjustment of the level of dense bed 20A and/or 20B, catalyst may be caused to flow through the slots in either direction as desired to the catalyst bed exerting a lower pressure. Such an arrangement permits a predetermined portion of the medium pore catalyst particles to be regenerated in the same unit used to regenerate the large pore catalyst, but at a much lower rate than the large pore catalyst particles. In an alternative embodiment, conduit 41 is provided for conducting a portion of stripped, spent catalyst from bed 20B to a regeneration unit, which may be the same or different than the unit receiving spent catalyst from bed 20A.

The above descriptions are illustrative of the present invention but are not intended as limiting the scope thereof, it being understood that the scope of the invention is defined by the claims which follow.

What is claimed is:

1. A process for the fluid catalytic cracking of at least two hydrocarbon feedstocks in the presence of finely divided solid catalytic cracking catalyst comprising a large pore size aluminosilicate zeolite selected from zeolite Y or zeolite USY, said process including the step of contacting a hydrocarbon feedstock with the cracking catalyst to produce cracked hydrocarbons and spent catalyst, comprising:

(a) contacting a first hydrocarbon feedstock in a first reaction zone with a first catalyst stream comprising said spent catalyst;

(b) contacting a second hydrocarbon feedstock in a second reaction zone with a catalyst stream comprising freshly regenerated zeolite Y or zeolite USY catalyst, said second hydrocarbon feedstock being a heavy hydrocarbon relative to said first hydrocarbon feedstock; and (c) introducing at least a portion of the effluent from said first reaction zone into said second reaction zone.

2. The process of claim 1 wherein said first reaction zone comprises a riser reaction zone and the contacting step (a) comprises passing a suspension comprising said first hydrocarbon feedstock and said first catalyst stream through said first riser reaction zone.

3. The process of claim 2 wherein said introducing step comprises introducing at least a portion of the effluent from said first riser reaction zone into said second reaction zone.

4. The process of claim 3 wherein said second reaction zone comprises a riser reaction zone and said contacting step (b) comprises passing a suspension comprising said first reaction zone effluent in admixture with said second hydrocarbon feedstock and said freshly regenerated catalyst through at least a portion of said second riser reaction zone.

5. The process of claim 1 or 4 wherein the first reaction zone temperature is from about 700° to about 1000° F. and wherein the second reaction zone temperature is from about 950° to about 1200° F.

6. The process of claim 1 wherein the temperature of said spent catalyst is from about 1000° F. to about 1100° F.

7. The process of claim 6 wherein the temperature of the regenerated catalyst is from about 1150° to about 1400° F.

8. The process of claim 1 or 4 wherein the first hydrocarbon feedstock is selected from the group consisting of lift fuel gas, liquid petroleum gas, medium cut naphtha, heavy cut naphtha, and mixtures thereof.

9. The process of claim 8 wherein the second hydrocarbon feedstock is a liquid hydrocarbon.

10. The process of claim 9 wherein the second hydrocarbon feedstock is a liquid hydrocarbon selected from the group consisting of, atmospheric gas oils, vacuum gas oils, coker gas oils, catalytic gas oils, hydrotreated gas oils, naphthas, catalytic naphthas, topped crudes, deasphalted oils, hydrotreated resids, hydrocracked resids, shale oil and mixtures of therefor.

11. A method of cracking a heavy hydrocarbon feedstock and a light hydrocarbon feedstock in a riser reactor, the method producing spent catalyst and regenerated catalyst, the spent and regenation catalyst comprising a large pore size aluminosilicate zeolite cracking catalyst selected from zeolite Y or USY said method comprising:

(a) contacting the light hydrocarbon feedstock with spent catalyst at an initial contact location in said riser;

(b) passing a suspension comprising said light hydrocarbon feedstock and said spent catalyst through said riser;

(c) introducing the heavy hydrocarbon feedstock into said suspension at a second location downstream of said initial contact location; and (d) introducing the regenerated catalyst into said suspension at a location in said riser downstream of said initial contact location.

12. The process of claim 11 wherein the mix temperature of the suspension in said riser at about the initial contact location is no greater than about 1000° F.

13. The process of claim 12 wherein the mix temperature of the suspension in said riser at about the regenerated catalyst introduction location is no less than about 1000° F.

14. The process of claim 13 wherein the mix temperature of the suspension in said riser at about the regenerated catalyst introduction location is from about 950° to about 1100° F.

15. The process of claim 11 wherein the temperature of said spent catalyst is from about 950° to about 1100° F.

16. The process of claim 15 wherein the temperature of the regenerated catalyst is from about 1100° F. to about 1400° F.

17. The process of claim 11 wherein the light hydrocarbon feedstock is selected from the group consisting of lift fuel gas, liquid petroleum gas, medium cut naphtha, heavy cut naphtha, and mixtures thereof.

18. The process of claim 17 wherein the heavy hydrocarbon feedstock is a liquid hydrocarbon.

19. The process of claim 18 wherein the heavy hydrocarbon feedstock is a liquid hydrocarbon selected from the group consisting of, atmospheric gas oils, vacuum gas oils, coker gas oils, catalytic gas oils, hydrotreated gas oils, naphthas, catalytic naphthas, topped crudes, deasphalted oils, hydrotreated resids, hydrocracked resids, shale oil and mixtures of therefor.

* * * * *